US006096978A

United States Patent [19]

Pohjola

[11] Patent Number: 6,096,978

[45] Date of Patent: Aug. 1, 2000

[54] FLAT CABLE AND METHOD FOR ITS MANUFACTURE

[75] Inventor: Jorma Pohjola, Varjakka, Finland

[73] Assignee: Oy IWS International Inc., Kempele, Finland

[21] Appl. No.: 09/202,749

[22] PCT Filed: Jun. 19, 1997

[86] PCT No.: PCT/FI97/00395

§ 371 Date: Dec. 18, 1998

§ 102(e) Date: Dec. 18, 1998

[87] PCT Pub. No.: WO97/49101

PCT Pub. Date: Dec. 24, 1997

[30] Foreign Application Priority Data

Jun. 19, 1996 [FI] Finland ..... 962544

[51] Int. Cl.[7] ..... H01B 7/08

[52] U.S. Cl. ..... 174/117 FF; 156/48; 156/51

[58] Field of Search ..... 174/117 F, 117 FF, 174/117 R, 117 AS, 68.3, 96; 156/48, 51, 55

[56] References Cited

U.S. PATENT DOCUMENTS

| | | | |
|---|---|---|---|
| 2,434,793 | 1/1948 | Feaster . | |
| 3,317,657 | 5/1967 | Eisler | 174/117 F |
| 3,413,405 | 11/1968 | Myers | 174/117 F X |
| 4,218,581 | 8/1980 | Suzuki . | |
| 4,746,769 | 5/1988 | Piper . | |

FOREIGN PATENT DOCUMENTS

| | | |
|---|---|---|
| 670577 | 6/1995 | European Pat. Off. . |
| 2030309 | 12/1971 | Germany . |
| 2032239 | 1/1972 | Germany . |
| 1415692 | 10/1974 | Germany . |
| 1529280 | 3/1977 | United Kingdom . |

*Primary Examiner*—Dean A. Reichard
*Assistant Examiner*—Chau N. Nguyen
*Attorney, Agent, or Firm*—Klauber & Jackson

[57] ABSTRACT

A flat cable having a metal conductors enclosed by a flexible insulation sheath. The conductors are flat and in a side by side orientation in the lateral direction and the conductors are provided with bends which enable a substantial increase in the length of the conductors upon extending the insulation sheath without breaking the conductors. The conductors are also provided at certain distances with short straight conductor sections that are oriented closer to the external surface of the flexible insulation sheath. The insulation sheath is constituted by an inner insulation which surrounds the conductors and a harder, outer insulation which serves as an actual protective cable sheath.

10 Claims, 3 Drawing Sheets

FLAT CABLE AND METHOD FOR ITS MANUFACTURE

BACKGROUND OF THE INVENTION

The present invention relates to a flat cable, wherein a flexible insulation sheath is used for enclosing one or a plurality of metal conductors, which is substantially flat and includes bends that make the conductor longer than the insulation sheath enclosing it so as to enable a substantial change in the conductor length upon extending or contracting the insulation sheath without breaking the conductor.

The invention relates also to a method for the manufacture of such a flat cable by extruding a plastic insulation sheath around flat conductors.

This type of flat cable is prior known from the publication print DE-1,415,692. It has the advantage that the risk of breaking the conductors is virtually eliminated while the cable can be bent to sharp angles and extended even as a result of rough handling. However, this prior known electric cable suffers from the defect that the joints cannot be made reliably by means of pins pierced through the insulation sheath without stripping the electric cable. Another drawback is that the cable is difficult to bend to permanent flexural shapes (bends) in the plane of the flat.

The electric harnesses for automobiles and vehicles in general are traditionally designed by extending separate wires to service points, such as signal lamps and headlights, by way of operating switches and fuses. All signal and warning lights have also been implemented by means of separate wires. A result of this is that the automobile electric harnesses constitute a labour-intensive and remarkably expensive part of an automobile. A second problem is the defect sensitivity of such electric harnesses, which is caused by a large number of joints between conductors and various components as well as by the fact that the conductors have a remarkably long total length, resulting in a considerable possibility of short circuits, e.g. as a consequence of attrition. The localization of contact faults and short circuits and the mending of defects in such electric harnesses is troublesome.

International patent application WO 93/10591 discloses an improved system, wherein the signal lamps and other such electrically operated items are connected in parallel to a common or just a few wire, whose conductor is supplied with a code in view of controlling the operation of the lamps and other such actuators. The lamp base or socket is provided with necessary electronics for identifying an operation control code intended for a particular lamp or some other actuator. This arrangement can be used for essentially simplifying the electric harness of an automobile for a substantial reduction in total costs and susceptibility to defects.

An object of this invention is to improve a flat cable of the above-mentioned type to make it useful especially in a system as set forth in the cited Patent publication WO 93/10591 or in a similar system. A first condition of this is that joints between a flat cable and actuators to be connected therewith can be made reliably through the insulation sheath without stripping the electric wires and a second condition is that the cable can be provided with permanent bends in accordance with the design of a vehicle.

SUMMARY OF THE INVENTION

In order to achieve this object with respect to the first condition, an electric wire of the invention is characterized in that the conductors are provided at certain distances with short straight conductor lengths. As for the second condition, the object is fulfilled such that the conductors are surrounded by an inner insulation, consisting of a yielding or resilient, yet tough type of plastics, and by an outer insulation at least over the two opposite flat sides of the cable, said outer insulation consisting of a harder plastics material than the inner insulation. The inner insulation does not oppose that the conductors adopt new permanent shapes as a result of bending. The outer insulation protects the cable from damages.

It is preferred that, along the straight conductor lengths, said conductor be substantially closer to one of the outer surfaces of the insulation sheath, i.e. be positioned eccentrically relative to the median of the wire, whereby a secure contact is established without a connecting pin having to pierce the entire cable.

BRIEF DESCRIPTION OF THE DRAWINGS

One exemplary embodiment of the invention will now be described in more detail with reference made to the accompanying drawings, in which.

DETAILED DESCRIPTION OF THE INVENTION

Figure 1:
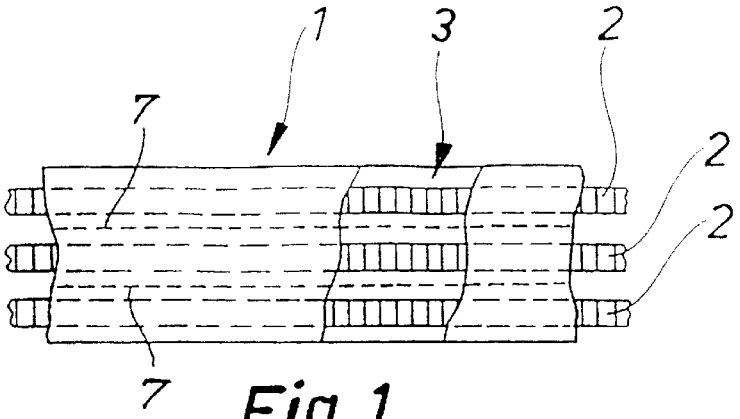
FIG. 1 shows a length cut out of an electric cable of the invention in a plan view and partially cut away.
Figure 2:
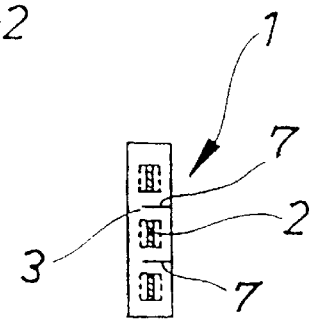
FIG. 2 shows the same in a cross-section.
Figure 3:
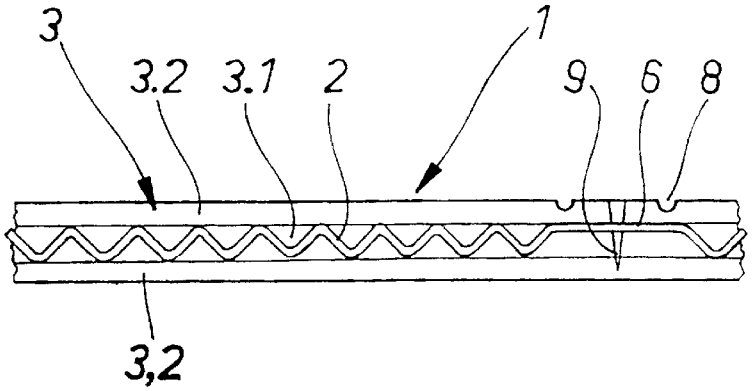
FIG. 3 shows the same in a longitudinal section (the insulation sheath cutting lines being omitted for the sake of clarity)
Figure 4:
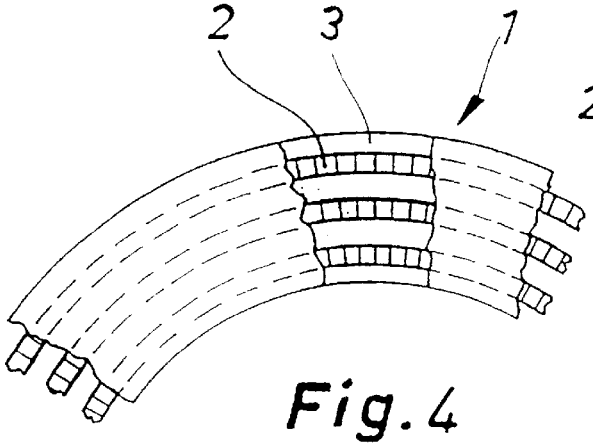
FIG. 4 illustrates the bending of flat cable of the invention to a curvature in the direction parallel to the plane of the wire and FIG. 5 illustrates the bending of the same cable to a curvature in the direction perpendicular to the plane of the flat cable.
Figure 5:
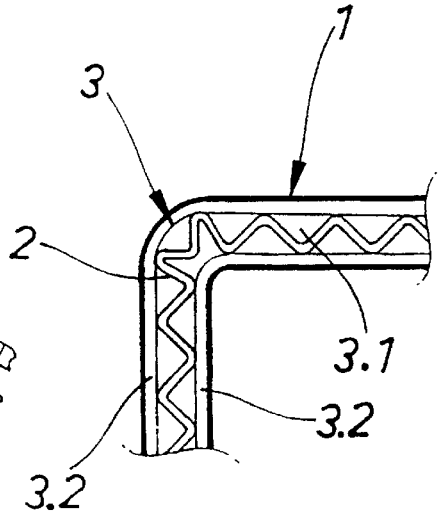
Figure 6:
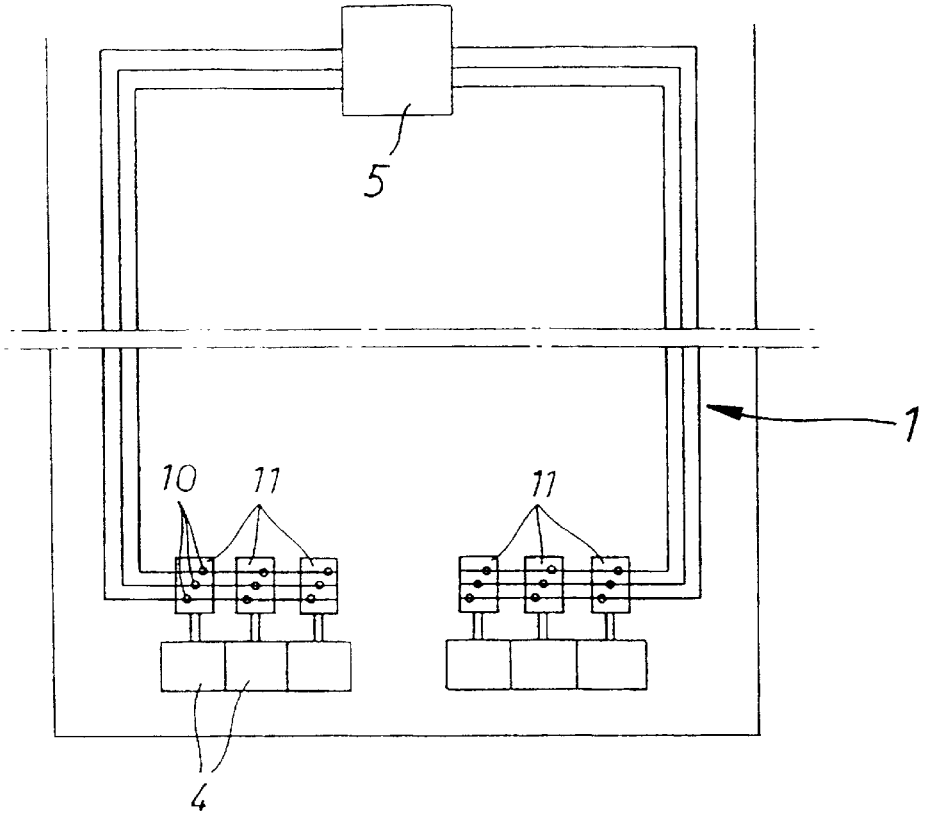
FIG. 6 depicts schematically a service application of the invention in a wiring system for the signal lamps of an automobile.

In the example shown in the drawings, an insulation sheath 3 of a flexible plastic material has been used to enclose three metal conductors 2, which are spaced from each other. The conductors 2 are flat, such that the width thereof is multiple, typically at least quadruple with respect to the thickness thereof. This ratio can even be considerably higher. The conductors 2 are positioned side by side in lateral direction, whereby an entire cable 1 becomes flat. The conductors 2 include bends or meanders, which are made by means of deflections perpendicular to the flat plane thereof. The bends may have a varying closeness and sharpness, yet they should be able to bring about a substantial increase or reduction in the length of the conductor. By virtue of the bends, the insulation sheath 3 can be extended without breaking the conductors 2. This facilitates e.g. the bending of a cable as shown in FIGS. 4 and 5, which is necessary for fitting the cables in proper locations within the encapsulation of an automobile. Such extensibility of cables without a risk of breaking is also required for the reason that the wires should sustain bumps and occasional rough handling without a risk of failure.

In order to optimize the strength of a cable and the capability of bending permanent deflections on a cable, it has been realized in the invention that an inner insulation 3.1 surrounding the conductors 2 is made of a yielding or resilient plastics and, thus, it does not resist the adaptation of the metal conductors 2 to a new shape, nor does it tend to return the cable back to its original shape. An outer insulation 3.2, lining at least the opposite flat sides of a cable, is made of a hard plastics which offers protection against mechanical bumps and abrasion.

In the case of FIG. 4, the outermost conductor 2 of the bending curve is forced to extend or elongate and the innermost conductor to contract. The middle conductor 2 can also be straight (non-tortuous). If the cable includes two conductors, one can be a straight and the other a tortuous conductor which can extend and contract as necessary. The invention also encompasses a cable, which only includes one flat, tortuous metal conductor, whereby the wiring can be implemented by using a plurality of individual cables side by side.

Figure 7:
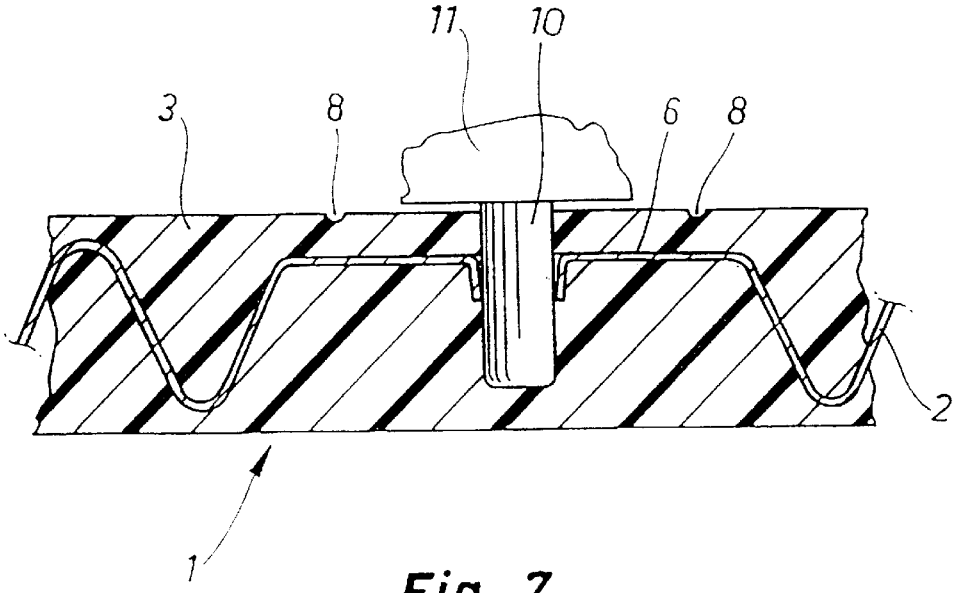
FIG. 7 shows a flat cable of the invention in a longitudinal section at a junction in an enlarged scale.

The flatness of the conductors 2 has an essential significance also in connection with a conductor joint, as set forth in the Applicant's International patent application No. PCT/FI94/00542. In order to be capable of making conductor joints reliably by means of pins 10 (FIG. 7) driven through the conductors 2 into the insulation sheath 3, the conductors 2 are provided at certain mutual distances with short straight sections or lengths 6. A denotation 8 indicating the location thereof can be visible on the external surface of the insulation sheath 3. The straight section 6 has typically a length which is within the range of 3–10 mm and these straight sections are included in the conductors 2 at distances of e.g. 45 mm. The denotation 8 can be a letter or a recess or any other visible mark. When intelligent contact terminals 11 are joined with the cable automatically, the straight conductor sections 6 can be identified with an electric detector even without any visible denotations. By virtue of the straight section 6, it is easier to make conductor joints by way of pin punching, which is a preferred mode of joining when using an automatic production line for manufacturing vehicular electric harnesses. Thus, in line with the straight conductor section 6 is made a preliminary hole 9 for facilitating the insertion of a connecting pin 10 into the wire through a hole in the conductor 2 to contact with the conductor 2. In order to establish a reliable contact without forcing the connecting pin 10 to pierce the entire insulation sheath, it is preferred that along the straight conductor sections 6 said conductor 2 be located substantially closer to one of the surfaces of the insulation sheath, i.e. be located eccentrically relative to the median of the wire. The straight conductor sections 6 may be level with the ridges of the conductor 2. Due to manufacturing technique, this level or plane is substantially included in the interface between the outer and inner insulation 3.2 and 3.1.

In view of the recycled use of conductor material, the conductors should be easily removable from the insulation sheath. Therefore, the flat side of the insulation sheath is provided with discontinuous incisions 7, which extend to the area between any given two adjacent conductors 2. The insulation remaining between the edge of the conductor 2 and the discontinuous incision 7 has a thickness of e.g. about 0.5–1 mm. Thus, the conductors can be readily withdrawn with the discontinuous incisions 7 ripping open upon being slashed by the sharp conductor edge. This is facilitated further by slash cutting which occurs as the conductor straightens out. The slashed portions of a discontinuous incision have a length of e.g. 2 mm and the webs therebetween have a length of 0.5 mm, which is sufficient to maintain the wire intact such that the incision 7 does not open in normal handling of the wire.

There may be a varying number of conductors 2, the minimum number being one and the preferred number being two, three or four, whereby one or two conductors are reserved for an operation control signal.

Figure 8:
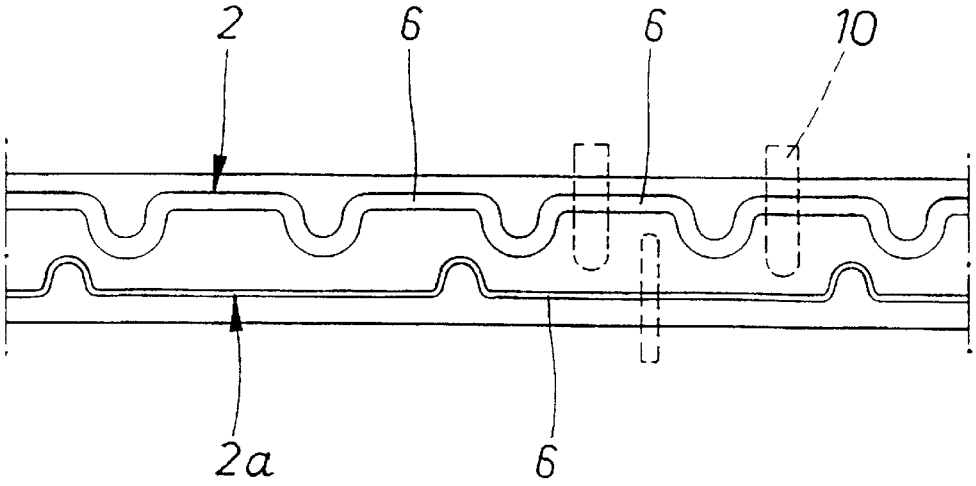
FIG. 8 shows a cable according to a second embodiment of the invention in a longitudinal section.

The embodiment shown in FIG. 8 is preferred for the reason that there are straight conductor sections 6 available over a major part of the cable length. In the illustrated case, all those sections of the conductor wire 2, which are closer to the cable surface, are substantially straight and longer and the conductor sections buried deeper in the cable. The same is implemented for a code wire 2*a* with even longer straight sections 6. The conductor and code wires 2, 2*a* are set on top of each other for a reduced cable width. The code wire 2*a* is thinner than the conductor wire 2.

This type of flat cable can be manufactured e.g. in such a way that the plastic sheath is extruded around the conductors after zigzagging the conductors between cylinders equipped with cogged peripheries, the cogging thereof having a spacing that is equal to the straight conductor section 6.

Figure 9:
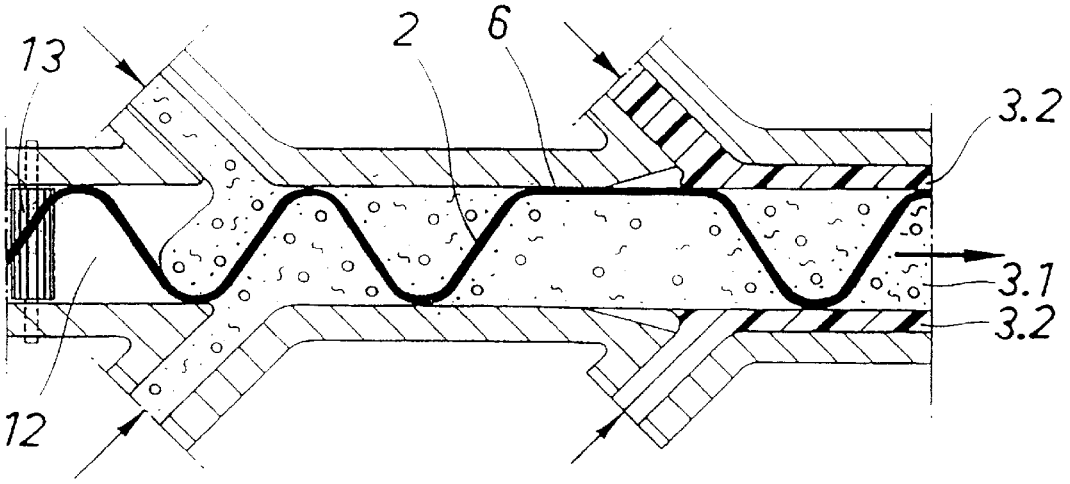
FIG. 9 depicts schematically a manufacturing process for a flat cable.

FIG. 9 illustrates schematically a flat-cable manufacturing process. The flat conductors 2 are withdrawn from rollers (not shown) and bent to a zigzag shape between cogged cylinders (not shown). The zigzagged conductors 2 are delivered side by side into an elongated mould cavity 12, 14. The adjacent conductors 2 are maintained at a small distance from each other by means of spacer elements 13, included in the inlet end of the cavity 12. Immediately downstream of the spacer elements 13, the cavity 12 is supplied on either side of the conductors 2 with a plastics material which, after setting, is yielding or resilient, but tough. The cavity 12 has a height which is substantially equivalent to the height between the ridges of the conductors 2, said ridges of the conductors 2 propping themselves against the top and bottom surfaces of the cavity 12, which thus prevent the conductors 2 from tilting. The resulting cable blank is carried into a larger cavity 14, which is supplied on either side of the cable blank with a second plastics material 3.2 which is harder than the first plastics material 3.1. The crust layers 3.2 constitute a mechanical protection for the cable.

The preliminary holes 9 are made either on automatic production lines for electric harnesses prior to the attachment of components 11 or the installer can make those with a manual tool during the course of final installations and repairs. Since the preliminary hole 9 has a diameter which is slightly less than that of the connecting pin 10, said 10 can be forced to a reliable contact with the edges of the hole in the conductor 2.

What is claimed is:

1. A flat cable, wherein a flexible insulation sheath (3) having an exterior surface is used for enclosing at least one metal conductor (2) which is substantially flat and includes conductor bend sections having bends forming a zigzagging configuration that make said at least one metal conductor (2) longer than the insulation sheath (3) enclosing said at least one metal conductor so as to enable a substantial change in said at least one metal conductor length without breaking said at least one metal conductor, characterized in that said at least one metal conductor (2) is provided at certain distances with straight conductor sections (6), which are located substantially closer to said exterior surface of the insulation sheath with respect to the median of said flat cable.

2. A flat cable as set forth in claim 1, characterized in that the straight conductor sections (6) closer to the cable exterior surface have a length which exceeds that of the conductor bend sections buried deeper in the cable.

3. A flat cable as set forth in claim 1 or 2, characterized in that the insulation sheath includes an inner insulation (3.1), made of a yielding or resilient, yet tough plastics material, and an outer insulation (3.2) over at least two opposite flat sides of the cable, said outer insulation (3.2) consisting of a harder plastics material than the inner insulation (3.2).

4. A flat cable as set forth in claim 3, characterized in that the straight conductor sections (6) are located substantially level with an interface between the outer and inner insulation (3.2, 3.1).

5. A flat cable as set forth in claim 1 or 2, characterized in that the insulation sheath (3) is provided with a discontinuous incision (7), having a depth which extends to the proximity of the edge of said at least one metal conductor (2).

6. A flat cable as set forth in claim 1, characterized in that the insulation sheath (3) is provided with a denotation (8) indicating the location of the straight conductor sections.

7. Application of a flat cable as set forth in claim 1 in a vehicle electric harness, such that a plurality of actuators (4) are connected in parallel to the flat cable (1) by means of connecting pins (10) included in intelligent contact terminals (11) whereby, in view of controlling operation of the actuators, said at least one conductor (2) is used for delivering a control code characteristic of each actuator.

8. The application of claim 7, characterized in that in line with the straight conductor section (6) is made a preliminary hole (9) for facilitating the insertion of one of said connecting pins (10) into said at least one metal conductor through a hole in an at least one metal conductor (2) to establish contact with the at least one metal conductor (2).

9. A method for manufacturing a flat cable, said method comprising the extrusion of a plastic insulation sheath (3) around at least two flat conductors (2), characterized in that the at least two flat conductors (2) are bent to form deflections, such that, in addition to the deflections, the at least two flat conductors include straight sections (6), the at least two conductors (2) are delivered side by side into an elongated mould cavity (12, 14), including a first cavity (12) and a second larger cavity (14), the at least two conductors (2) are maintained at a small distance apart by means of spacer elements (13), the first cavity (12) is supplied around the at least two conductors (2) with a plastics material (3.1), the flat cable is delivered into the second, larger cavity (14) and another plastics material (3.2), is supplied around the flat cable.

10. A method as set forth in claim 9, characterized in that the plastics material (3.1) to be supplied into the first cavity (12) is more resilient or softer than said other plastics material (3.2) to be supplied into the second cavity (14).

* * * * *

UNITED STATES PATENT AND TRADEMARK OFFICE

CERTIFICATE OF CORRECTION

PATENT NO : 6,096,978

DATED : August 1, 2000

INVENTOR(S) : Jorma Pohjola

It is certified that error appears in the above-identified patent and that said Letters Patent are hereby corrected as shown below:

Please change item [73] from "Oy IWS International Inc." to read

- -IWS International Inc.- -.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*